US008967253B2

(12) United States Patent
Ciglenec et al.

(10) Patent No.: US 8,967,253 B2
(45) Date of Patent: Mar. 3, 2015

(54) PUMP CONTROL FOR FORMATION TESTING

(75) Inventors: Reinhart Ciglenec, Katy, TX (US); Steven G. Villareal, Houston, TX (US); Albert Hoefel, Sugar Land, TX (US); Peter Swinburner, Houston, TX (US); Michael J. Stucker, Sugar Land, TX (US); Jean-Marc Follini, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 866 days.

(21) Appl. No.: 13/185,609

(22) Filed: Jul. 19, 2011

(65) Prior Publication Data

US 2011/0276187 A1 Nov. 10, 2011

Related U.S. Application Data

(62) Division of application No. 12/500,725, filed on Jul. 10, 2009, and a division of application No. 11/616,520, filed on Dec. 27, 2006, now Pat. No. 7,594,541.

(51) Int. Cl.

| | |
|---|---|
| ***E21B 47/00*** | (2012.01) |
| ***E21B 49/10*** | (2006.01) |
| *G01F 1/00* | (2006.01) |
| *G01F 7/00* | (2006.01) |
| *E21B 34/06* | (2006.01) |
| *E21B 49/08* | (2006.01) |

(Continued)

(52) U.S. Cl.

CPC ..... *E21B 49/10* (2013.01)
USPC ..... 166/255.2; 166/264; 166/250.02; 166/250.05; 166/250.15; 166/373; 700/281; 700/282

(58) Field of Classification Search

CPC ..... E21B 49/10
USPC ..... 700/281–282; 702/45–49, 55; 73/1.16–1.36, 1.73–1.74; 166/105, 166/264, 373, 255.2, 250.02, 250.05, 166/250.15

See application file for complete search history.

(56) References Cited

U.S. PATENT DOCUMENTS

| | | | |
|---|---|---|---|
| 3,934,468 | A | 1/1976 | Brieger |
| 4,860,581 | A | 8/1989 | Zimmerman et al. |

(Continued)

FOREIGN PATENT DOCUMENTS

| | | | |
|---|---|---|---|
| GB | 2390105 | A | 12/2003 |
| WO | 0151761 | A1 | 7/2001 |

OTHER PUBLICATIONS

U.S. Appl. No. 12/366,741, filed Feb. 2009, Ciglenec et al.*

(Continued)

*Primary Examiner* — Ramesh Patel
(74) *Attorney, Agent, or Firm* — Kenneth L. Kincaid; Cathy Hewitt

(57) ABSTRACT

A downhole formation fluid pumping and a sampling apparatus are disclosed that may form part of a formation evaluation while drilling tool or part of a tool pipe string. The operation of the pump is optimized based upon parameters generated from formation pressure test data as well as tool system data thereby ensuring optimum performance of the pump at higher speeds and with greater dependability. New pump designs for fluid sampling apparatuses for use in MWD systems are also disclosed.

25 Claims, 9 Drawing Sheets

(51) Int. Cl.

| | |
|---|---|
| *G05D 7/00* | (2006.01) |
| *G05D 11/00* | (2006.01) |

(56) References Cited

U.S. PATENT DOCUMENTS

| | | | | |
|---|---|---|---|---|
| 4,893,505 | A | 1/1990 | Marsden et al. | |
| 4,936,139 | A | 6/1990 | Zimmerman et al. | |
| 5,209,309 | A | 5/1993 | Wilson | |
| 5,622,223 | A | 4/1997 | Vasquez | |
| 5,644,076 | A | 7/1997 | Proett et al. | |
| 5,799,733 | A | 9/1998 | Ringgenberg et al. | |
| 5,984,641 | A | 11/1999 | Bevan et al. | |
| 6,041,856 | A | 3/2000 | Thrasher et al. | |
| 6,058,773 | A | 5/2000 | Zimmerman et al. | |
| 6,220,087 | B1 | 4/2001 | Hache et al. | |
| 6,415,877 | B1 * | 7/2002 | Fincher et al. | 175/5 |
| 6,543,544 | B2 | 4/2003 | Schultz et al. | |
| 6,672,386 | B2 * | 1/2004 | Krueger et al. | 166/252.5 |
| 6,880,647 | B2 | 4/2005 | Villareal | |
| 6,914,538 | B2 | 7/2005 | Baird et al. | |
| 6,986,282 | B2 | 1/2006 | Ciglenec et al. | |
| 7,031,841 | B2 | 4/2006 | Zazovsky et al. | |
| 7,062,959 | B2 | 6/2006 | Kurkjian et al. | |
| 7,114,562 | B2 | 10/2006 | Fisseler et al. | |
| 7,114,581 | B2 * | 10/2006 | Aronstam et al. | 175/57 |
| 7,117,734 | B2 | 10/2006 | Follini et al. | |
| 7,124,819 | B2 * | 10/2006 | Ciglenec et al. | 166/264 |
| 7,137,450 | B2 | 11/2006 | Johansen et al. | |
| 7,178,392 | B2 * | 2/2007 | Dhruva et al. | 73/152.51 |
| 7,222,524 | B2 | 5/2007 | Shammai | |
| 7,234,521 | B2 * | 6/2007 | Shammai et al. | 166/264 |
| 7,266,983 | B2 * | 9/2007 | Krueger et al. | 73/152.22 |
| 7,302,966 | B2 | 12/2007 | Brennan, III et al. | |
| 7,373,812 | B2 | 5/2008 | Ma et al. | |
| 7,543,659 | B2 | 6/2009 | Partouche et al. | |
| 2003/0226663 | A1 * | 12/2003 | Krueger et al. | 166/252.5 |
| 2004/0045706 | A1 | 3/2004 | Pop et al. | |
| 2004/0206548 | A1 * | 10/2004 | Aronstam et al. | 175/57 |
| 2004/0221983 | A1 | 11/2004 | Ma et al. | |
| 2004/0231842 | A1 * | 11/2004 | Shammai et al. | 166/264 |
| 2005/0039527 | A1 * | 2/2005 | Dhruva et al. | 73/152.27 |
| 2005/0115716 | A1 * | 6/2005 | Ciglenec et al. | 166/373 |
| 2005/0178557 | A1 | 8/2005 | Johansen et al. | |
| 2005/0187715 | A1 | 8/2005 | Follini et al. | |
| 2006/0054323 | A1 | 3/2006 | Grant et al. | |
| 2006/0243493 | A1 | 11/2006 | El-Rayes et al. | |
| 2006/0254819 | A1 | 11/2006 | Moriarty | |
| 2007/0198192 | A1 | 8/2007 | Hsu et al. | |
| 2008/0053212 | A1 | 3/2008 | Brennan et al. | |
| 2008/0135239 | A1 | 6/2008 | Edwards | |
| 2008/0156486 | A1 * | 7/2008 | Ciglenec et al. | 166/264 |
| 2008/0156531 | A1 | 7/2008 | Boone et al. | |

OTHER PUBLICATIONS

U.S. Appl. No. 11/616,520, filed Dec. 2006, Ciglenec et al.*

French Preliminary Search Report and Written Opinion for French Application No. FR0759412 dated Aug. 5, 2013.

* cited by examiner

PUMP CONTROL FOR FORMATION TESTING

CROSS-REFERENCE TO RELATED APPLICATIONS

This application is a divisional of U.S. patent application Ser. No. 12/500,725, filed Jul. 10, 2009, which is a continuation of U.S. patent application Ser. No. 11/616,520, filed Dec. 27, 2006, now U.S. Pat. No. 7,594,541, which are both hereby incorporated by reference in their entireties.

BACKGROUND

1. Technical Field

This disclosure is directed toward geological formation testing. More specifically, this disclosure is directed toward controlling the pump or fluid displacement unit (FDU) of a formation testing tool.

2. Description of the Related Art

Wells are generally drilled into the ground or ocean bed to recover natural deposits of oil and gas, as well as other desirable materials, that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the borehole wall.

For successful oil and gas exploration, it is necessary to have information about the subsurface formations that are penetrated by a borehole. For example, one aspect of standard formation evaluation relates to the measurements of the formation pressure and formation permeability. These measurements are essential to predicting the production capacity and production lifetime of a subsurface formation.

One technique for measuring formation properties includes lowering a "wireline" tool into the well to measure formation properties. A wireline tool is a measurement tool that is suspended from a wire as it is lowered into a well so that is can measure formation properties at desired depths. A typical wireline tool may include a probe that may be pressed against the borehole wall to establish fluid communication with the formation. This type of wireline tool is often called a "formation tester." Using the probe, a formation tester measures the pressure of the formation fluids, generates a pressure pulse, which is used to determine the formation permeability. The formation tester tool also typically withdraws a sample of the formation fluid for later analysis.

In order to use any wireline tool, whether the tool be a resistivity, porosity or formation testing tool, the drill string must be removed from the well so that the tool can be lowered into the well. This is called a "trip" downhole. Further, the wireline tools must be lowered to the zone of interest, generally at or near the bottom of the hole. A combination of removing the drill string and lowering the wireline tools downhole are time-consuming measures and can take up to several hours, depending upon the depth of the borehole. Because of the great expense and rig time required to "trip" the drill pipe and lower the wireline tools down the borehole, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

As an improvement to wireline technology, techniques for measuring formation properties using tools and devices that are positioned near the drill bit in a drilling system have been developed. Thus, formation measurements are made during the drilling process and the terminology generally used in the art is "MWD" (measurement-while-drilling) and "LWD" (logging-while-drilling). A variety of downhole MWD and LWD drilling tools are commercially available. Further, formation measurements can be made in tool strings which are not have a drill bit a lower end thereof, but which are used to circulate mud in the borehole.

MWD typically refers to measuring the drill bit trajectory as well as borehole temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. The distinction between LWD and MWD is not germane to this disclosure.

Formation evaluation while drilling tools capable of performing various downhole formation testing typically include a small probe or pair of packers that can be extended from a drill collar to establish hydraulic coupling between the formation and pressure sensors in the tool so that the formation fluid pressure may be measured. Some existing tools use a pump to actively draw a fluid sample out of the formation so that it may be stored in a sample chamber in the tool for later analysis. Such a pump may be powered by a generator in the drill string that is driven by the mud flow down the drill string.

However, as one can imagine, multiple moving parts involved in any formation testing tool, either of wireline or MWD, can result in equipment failure or less than optimal performance. Further, at significant depths, substantial hydrostatic pressure and high temperatures are experienced thereby further complicating matters. Still further, formation testing tools are operated under a wide variety of conditions and parameters that are related to both the formation and the drilling conditions.

Therefore, what is needed are improved downhole formation evaluation tools and improved techniques for operating and controlling such tools so that such downhole formation evaluation tools are more reliable, efficient, and adaptable to both formation and mud circulation conditions.

SUMMARY OF THE DISCLOSURE

In one embodiment, a fluid pump system for a downhole tool connected to a pipe string positioned in a borehole penetrating a subterranean formation is disclosed. The system includes a pump that is in fluid communication with at least one of the formation and the borehole, and that is powered by mud flowing downward through the pipe string. The pump is linked to a controller which controls the pump speed based upon at least one parameter selected from the group consisting of mud volumetric flow rate, tool temperature, formation pressure, fluid mobility, system losses, mechanical load limitations, borehole pressure, available power, electrical load limitations and combinations thereof.

In another embodiment, a fluid pump system for a downhole tool connected to a pipe string positioned in a borehole penetrating a subterranean formation is disclosed. The system includes a turbine, a transmission, a pump, a first sensor and a controller. The turbine is powered by mud flowing downward through the pipe string. The turbine and pump are operatively connected to the transmission with a first sensor being coupled to one of the turbine and the mud flow for sensing at least one of turbine speed and mud flow rate. The controller is communicably coupled to the transmission and the sensor, such that the controller adjusts the transmission based on one of the speed of the turbine and the mud flow rate.

In yet another embodiment, a method for controlling the pump of a downhole tool is disclosed. The method includes providing the tool with a downhole controller for controlling a pump; measuring at least one system parameter of the tool disposed in a wellbore; calculating a pump operation limit for the pump based upon the at least one system parameter; operating the pump; and limiting the pump operation of the pump with the controller.

In another embodiment, a method for operating a pump system for a downhole tool connected to a pipe string positioned in a borehole penetrating a subterranean formation is disclosed. The method includes rotating a turbine disposed in the wellbore with mud flowing downward through the pipe string; obtaining a power output from the turbine; operating a pump with the power output from the turbine; measuring the speed of the turbine; and adjusting a transmission disposed between the turbine and the pump with a controller disposed in the tool based on the speed of the turbine.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

This disclosure relates to fluid pumps and sampling systems described below and illustrated in FIGS. 2-8 that may be used in a downhole drilling environment, such as the one illustrated in FIG. 1. In some refinements, this disclosure relates to methods for using and controlling the disclosed fluid pumps. In one or more refinements, a formation evaluation while drilling tool includes an improved fluid pump and an improved method of controlling the operation of the pump. In some other refinements, improved methods of formation evaluation while drilling are disclosed.

Those skilled in the art given the benefit of this disclosure will appreciate that the disclosed apparatuses and methods have application during operation other than drilling and that drilling is not necessary to practice this invention. While this disclosure relates mainly to sampling, the disclosed apparatus and method can be applied to other operations including injection techniques.

The phrase "formation evaluation while drilling" refers to various sampling and testing operations that may be performed during the drilling process, such as sample collection, fluid pump out, pretests, pressure tests, fluid analysis, and resistivity tests, among others. It is noted that "formation evaluation while drilling" does not necessarily mean that the measurements are made while the drill bit is actually cutting through the formation. For example, sample collection and pump out are usually performed during brief stops in the drilling process. That is, the rotation of the drill bit is briefly stopped so that the measurements may be made. Drilling may continue once the measurements are made. Even in embodiments where measurements are only made after drilling is stopped, the measurements may still be made without having to trip the drill string.

In this disclosure, "hydraulically coupled" is used to describe bodies that are connected in such a way that fluid pressure may be transmitted between and among the connected items. The term "in fluid communication" is used to describe bodies that are connected in such a way that fluid can flow between and among the connected items. It is noted that "hydraulically coupled" may include certain arrangements where fluid may not flow between the items, but the fluid pressure may nonetheless be transmitted. Thus, fluid communication is a subset of hydraulically coupled.

Figure 1:
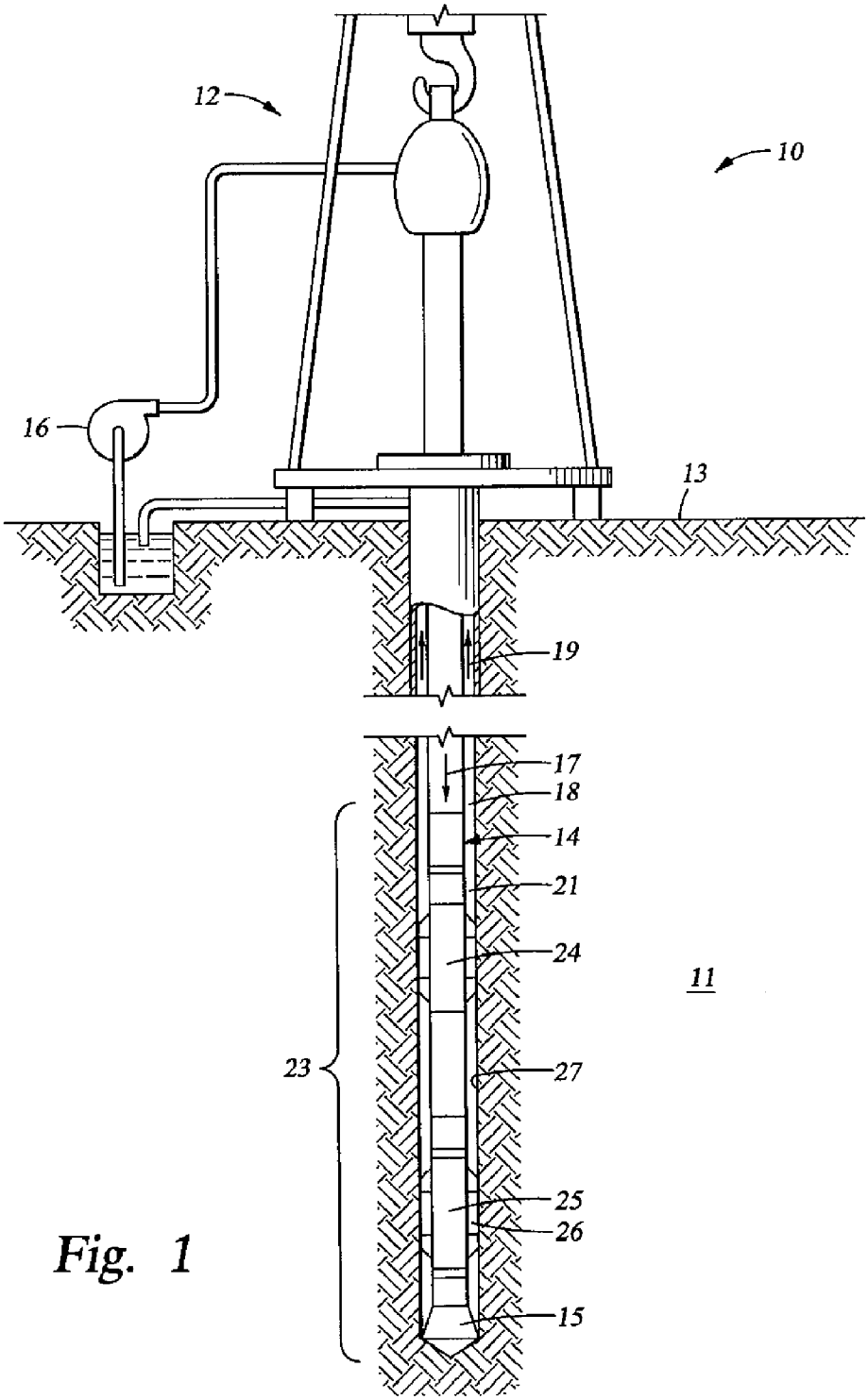
FIG. 1 is a front elevation view depicting a drilling system in which the disclosed formation testing system may be employed.

FIG. 1 illustrates a drilling system 10 used to drill a well through subsurface formations, shown generally at 11. A drilling rig 12 at the surface 13 is used to rotate a drill string 14 that includes a drill bit 15 at its lower end. The reader will note that this disclosure relates generally to work strings that do not include a drill bit 15 at the lower end thereof which are lowered into the wellbore like a drill string and that allow for mud circulation similar to the way a drill string 14 circulates mud. As the drill bit 15 is being rotated, a "mud" pump 16 is used to pump drilling fluid, commonly referred to as "mud" or "drilling mud," downward through the drill string 14 in the direction of the arrow 17 to the drill bit 15. The mud, which is used to cool and lubricate the drill bit, exits the drill string 14 through ports (not shown) in the drill bit 15. The mud then carries drill cuttings away from the bottom of the borehole 18 as it flows back to the surface 13 as shown by the arrow 19 through the annulus 21 between the drill string 14 and the formation 11. While a drill string 14 is shown in FIG. 1, it will be noted here that this disclosure is also applicable to work strings and pipe strings as well.

At the surface 13, the return mud is filtered and conveyed back to the mud pit 22 for reuse. The lower end of the drill string 14 includes a bottom-hole assembly ("BHA") 23 that includes the drill bit 15, as well as a plurality of drill collars 24, 25 that may include various instruments, such as LWD or MWD sensors and telemetry equipment. A formation evaluation while drilling instrument may, for example, may also include or be disposed within a centralizer or stabilizer 26.

The stabilizer 26 comprises blades that are in contact with the borehole wall as shown in FIG. 1 to limit "wobble" of the drill bit 15. "Wobble" is the tendency of the drill string, as it rotates, to deviate from the vertical axis of the wellbore 18 and cause the drill bit to change direction. Advantageously, a stabilizer 26 is already in contact with the borehole wall 27, thus, requiring less extension of a probe to establish fluid communication with the formation. Those having ordinary skill in the art will realize that a formation probe could be disposed in locations other than in a stabilizer without departing from the scope of this disclosure.

Figure 2:
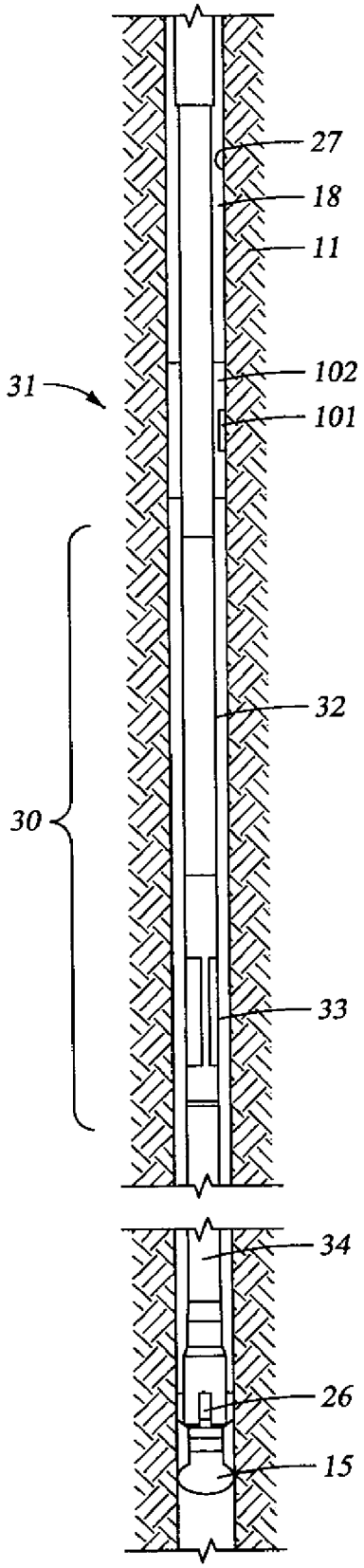
FIG. 2 is a front elevation view depicting one embodiment of a bottom hole assembly (BHA) in a wellbore made in accordance with this disclosure.

Turning to FIG. 2, a disclosed fluid sampling tool 30 hydraulically connects to the downhole formation via pressure testing tool shown generally at 31. The tool 31 comprises an extendable probe and resetting pistons as shown, for example, in U.S. Pat. No. 7,114,562. The fluid sampling tool 30 preferably includes a fluid description module and a fluid pumping module, both of which are disposed in the module or section 32 and, optionally, a sample collection module 33. Various other MWD instruments or tools are shown at 34 which may include, but are not limited to, resistivity tools, nuclear (porosity and/or density) tools, etc. The drill bit stabilizers are shown at 26 and the drill bit is shown at 15 in FIG. 2. It will be noted that the relative vertical placement of the components 31, 32, 33 and 34 can vary and that the MWD modules 34 can be placed above or below the pressure tester module 31 and the fluid pumping and analyzing module 32 as well as the fluid sample collection module 33 can also be placed above or below the pressure testing module 31 or MWD modules 34. Each module 31-34 will usually have a length ranging from about 30 to about 40 feet.

Figure 3:
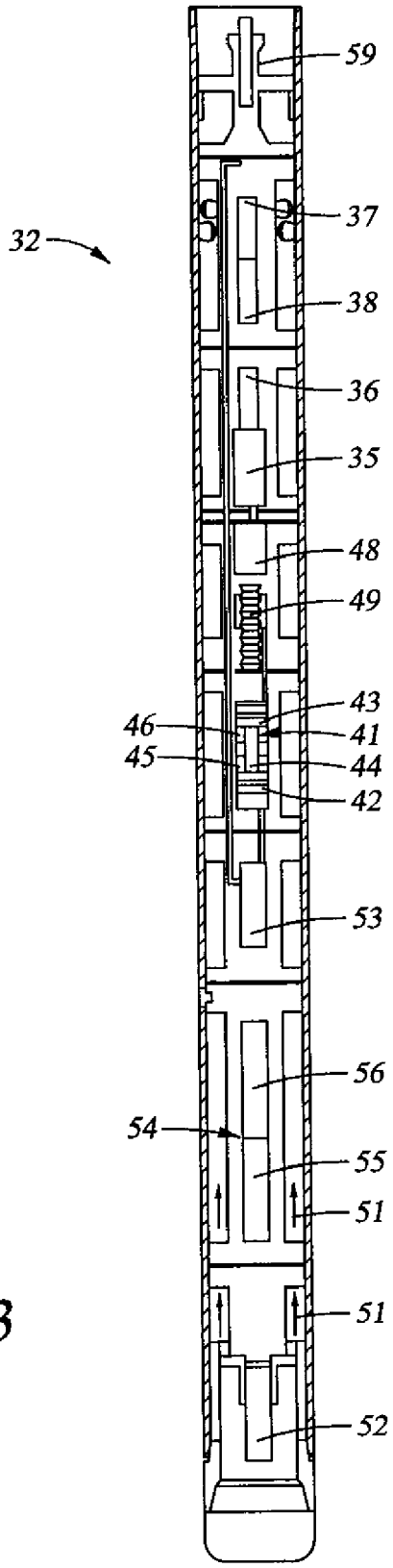
FIG. 3 is a sectional view illustrating a fluid analysis and pump-out module of a disclosed formation testing system.
Figure 4:
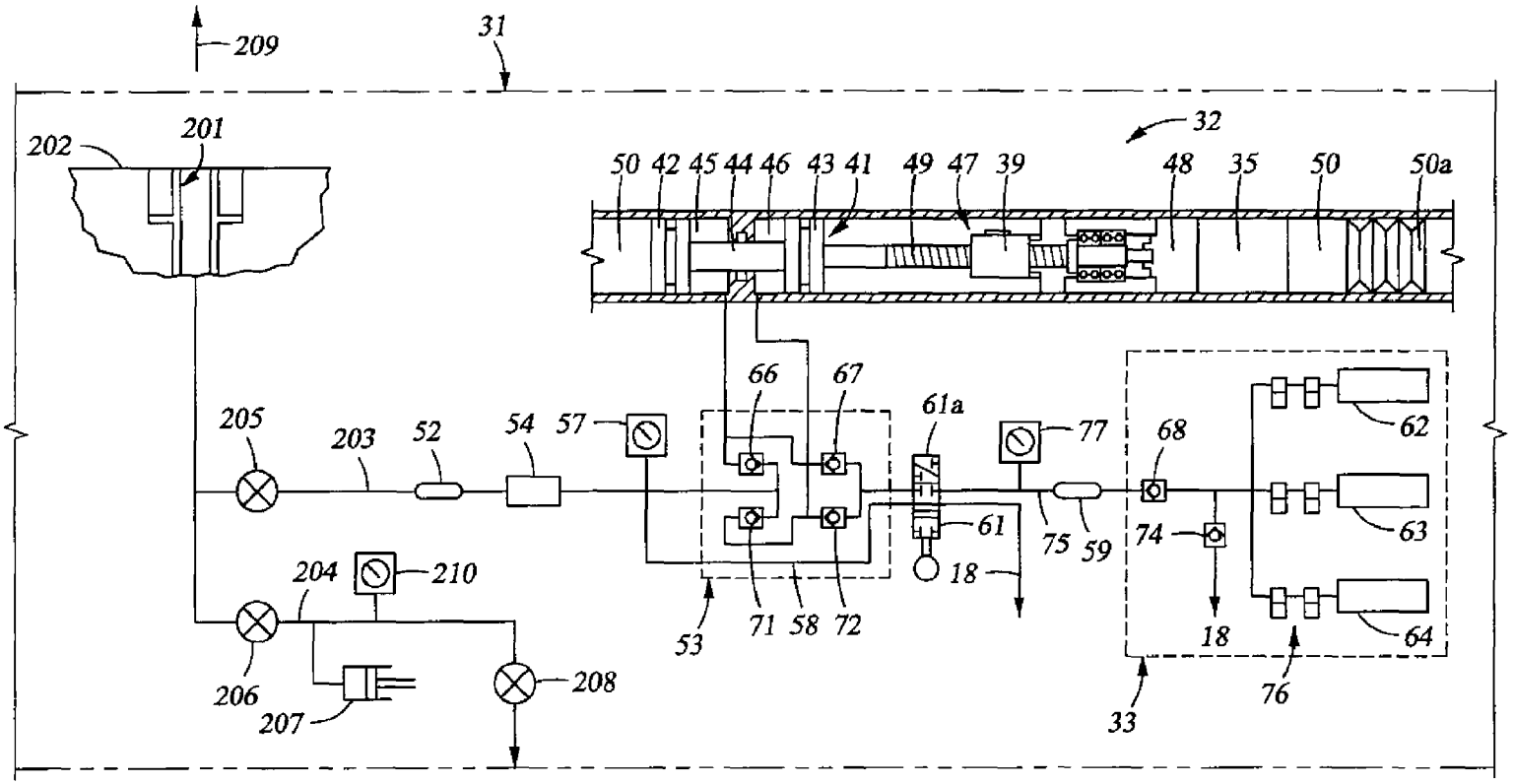
FIG. 4 schematically illustrates a pump for delivering formation fluid from a probe disposed in a tool blade into sample chambers, which are also illustrated.

Turning to FIG. 3, a formation fluid pump and analysis module 32 is disclosed with highly adaptive control features. Various features disclosed in FIGS. 3 and 4 are used to adjust for changing environmental conditions in-situ. To cover a wide performance range, ample versatility is necessary to run the pump motor 35, together with sophisticated electronics or controller 36 and firmware for accurate control.

Power to the pump motor 35 is supplied from a dedicated turbine 37 which drives and alternator 38. The pump 41, in one embodiment, includes two pistons 42, 43 connected by a shaft 44 and disposed within corresponding cylinders 45, 46 respectively. The dual piston 42, 43/cylinder 45, 46 arrangement works through positive volume displacement. The piston 42, 43 motion is actuated via the planetary roller-screw 47 also detailed in FIG. 4, which is connected to the electric motor 35 via a gearbox 48. The gearbox or transmission 48 driven by the motor may be used to vary a transmission ratio between the motor shaft and the pump shaft. Alternatively, the combination of the motor 35 and the alternator 38 may be used to accomplish the same objective.

The motor 35 may be part or integral to the pump 41, but alternatively may be a separate component. The planetary roller screw 47 comprises a nut 39 and a threaded shaft 49. In a preferred embodiment, the motor 35 is a servo motor. The power of the pump 41 should be at least 500 W, which corresponds to about 1 kW at the alternator 38 of the tool 32, and preferably at least about 1 kW, which corresponds to at least about 2 kW at the alternator 38.

In lieu of the planetary roller-screw 47 arrangement shown in FIG. 4, other means for fluid displacement may be employed such as lead screw or a separate hydraulic pump, which would output alternating high-pressure oil that could be used to reciprocate the motion of the piston assembly 42, 43, 44.

Returning to FIG. 3, the sampling/analysis drill module 32 is shown with primary components in one particular arrangement, but other arrangements are obviously possible and within the knowledge of those skilled in the art. The arrows 51 indicate the flow of drilling mud through the module 32. An extendable hydraulic/electrical connector 52 is used to connect the module 32 to the testing tool 31 (see FIG. 2) and another extendable hydraulic/electrical connector 59 is used to connect the module 32 to the sample collection module 33 (FIG. 2). Examples of hydraulic connectors suitable for connecting collars can be found for example in U.S. patent application Ser. No. 11/160,240, assigned to the assignee of the present invention, and incorporated by reference herein. The downhole formation fluid enters the tool string through the pressure testing tool 31 (FIG. 2) and is routed to the valve block 53 via the extendable hydraulic/electrical connector 52. Still referring to FIG. 3, at the valve block 53, the fluid sample is initially pumped through the fluid identification unit 54. The fluid identification unit 54 comprises an optics module 55 together with other sensors (not shown) and a controller 56 to determine fluid composition—oil, water, gas, mud constituents—and properties such as density, viscosity, resistivity, etc.

From the fluid identification unit 54, the fluid enters the fluid displacement unit (FDU) or pump 41 via the set of valves in the valve block 53 which is explained in greater detail in connection with FIG. 4. As seen in FIG. 3, before the fluid reaches the valve block 53, it proceeds from the probe of the pressure tester 31 through the hydraulic/electrical connector 52 and through the analyzer 54.

FIG. 3 also shows a schematic diagram from a probe 201 disposed, for example, in a blade 202 of the tool 31 (see also FIG. 2). Two flow lines 203, 204 extend from the probe 201. The flow lines 203, 204 can be independently isolated by manipulating the sampling isolation valve 205 and/or the pretest isolation valve 206. The flow line 203 connects the pump and analyzer tool 32 to the probe 201 in the tester tool 31. The flow line 204 is used for "pretests."

During a pretest, the sampling isolation valve 205 to the tool 32 is closed, the pretest isolation valve 206 to the pretest piston 207 is open, and the equalization valve 208 is closed. The probe 201 is extended toward the formation is indicated by the arrow 209 and, when extended, is hydraulically coupled to the formation (not shown). The pretest piston 207 is retracted in order to lower the pressure in the flow line 204 until the mud cake is breached. The pretest piston 207 is then stopped and the pressure in the flow line 204 increases as it approaches the formation pressure. The formation pressure data can be collected during the pretest. The data collected during the pretest (or other analogous test) may become one of the parameters used in part 85 of FIG. 5 as discussed below. The pretest can also be used to determine that the probe 201 and the formation are hydraulically coupled.

Referring to FIG. 4, the fluid gets routed to either one of the two displacement chambers 45 or 46. The pump 41 operates such that there is always one chamber 45 or 46 drawing fluid in, while the opposite 45 or 46 is expulsing fluid. Depending on the fluid routing and equalization valve 61 setting, the exiting liquid is pumped back to the borehole 18 (or borehole annulus) or through the hydraulic/electrical connector 59 to one of the sample chambers 62, 63, 64, which are located in an adjoining separate drill collar 33 (see also FIG. 2). While only three sample chambers 62, 63, 64 are shown, it will be noted that more or less than three chambers 62, 63, 64 may be employed. Obviously, the number of chambers is not critical and the choice of three chambers constitutes but one preferred design.

Still referring to FIG. 4, the pumping action of the FDU pistons 42, 43 is achieved via the planetary roller screw, 47 nut 39 and threaded shaft 49. The variable speed motor 35 and associated gearbox 48 drives the shaft 49 in a bi-directional mode under the direction of the controller 36 shown in FIG. 3. Gaps between the components are filled with oil 50 and an annulus bellows compensator is shown at 50*a*.

Still referring to FIG. 4, during intake into the chamber 45, fluid passes into the valve block 53 and past the check valve 66 before entering a the chamber 45. Upon output from the chamber 45, fluid passes through the check valve 67 to the fluid routing and equalization valve 61 where it is either dumped to the borehole 18 or passed through the hydraulic/electrical connector 59, check valve 68 and into one of the chambers 62-64. Similarly, upon intake into the chamber 46, fluid passes through the check valve 71 and into the chamber 46. Upon output from the chamber 46, fluid passes through the check valve 72, through the fluid routing and equalization valve 61 and either to the borehole 18 or to the fluid sample collector module 33.

During a sample collecting operation, fluid gets initially pumped to the module 32 and exits the module 32 via the fluid routing and equalization valve 61 to the borehole 18. This action flushes the flow-line 75 from residual liquid prior to actually filling a sample bottle 62-64 with new or fresh formation fluid. Opening and closing of a bottle 62-64 is performed with sets of dedicated seal valves, shown generally at 76 which are linked to the controller 36 or other device. The pressure sensor 77 is useful, amongst other things, as a indicative feature for detecting that the sample chambers 62-64 are all full. Relief valve 74 is useful, amongst other things, as a safety feature to avoid over pressuring the fluid in the sample chamber 62-64. Relief valve 74 may also be used when fluid needs to be dumped to the borehole 18.

Returning to FIG. 3, a dedicated turbine-alternator 37, 38 is needed to provide the necessary amount of electrical power to drive the pump 41. It is an operational requirement that during sampling operations mud is being pumped through the drill string 14. Pumping rates need to be sufficient to ensure both MWD mud pulse telemetry communication back to surface as well (if utilized) as sufficient angular velocity for the turbine 37 to provide adequate power to the motor 35 for the pump 41.

Figure 5:
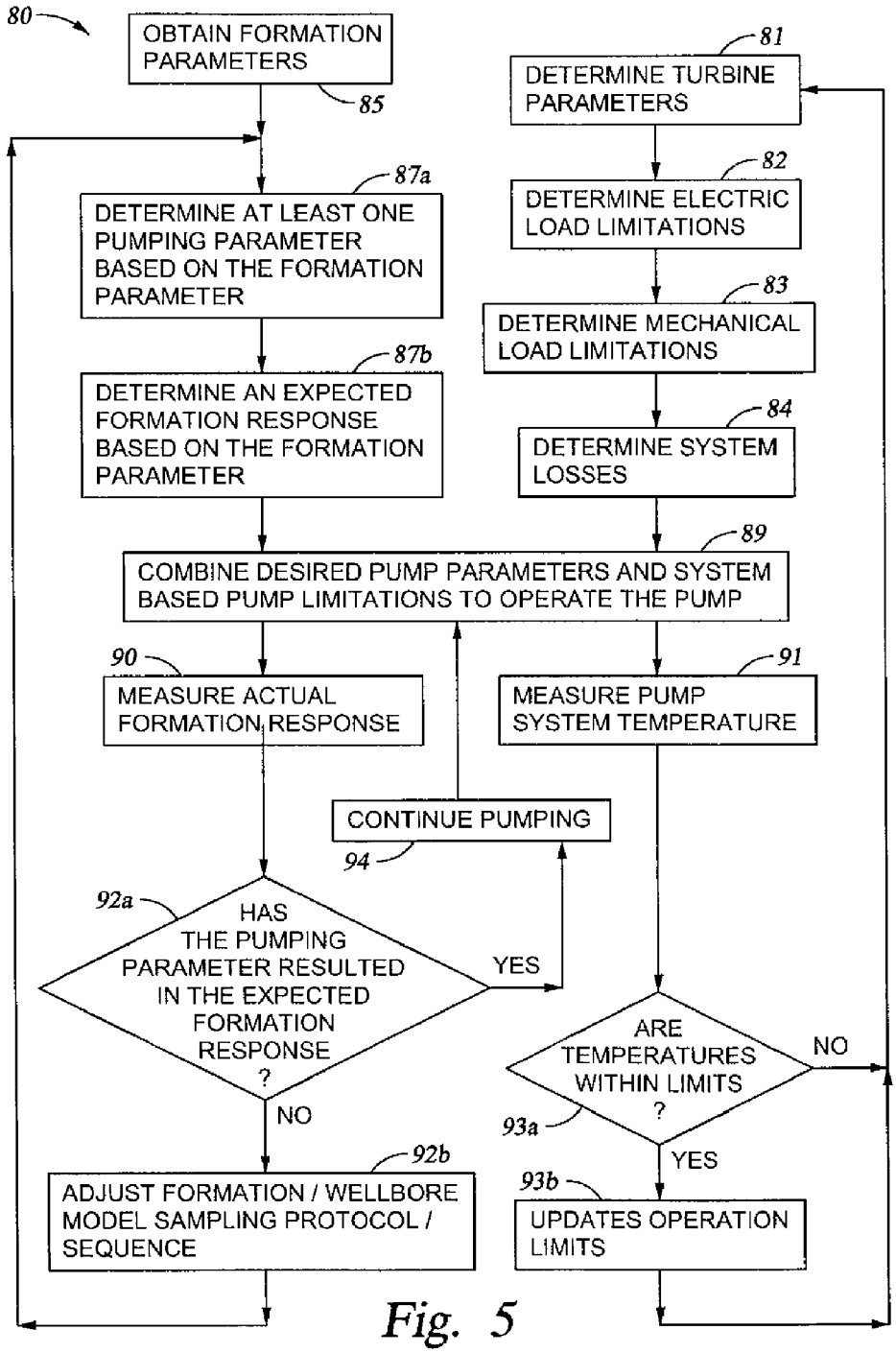
FIG. 5 is a flow diagram illustrating one method disclosed herein for utilizing formation and system parameters for controlling a pump in a formation testing tool.

FIG. 5 illustrates one disclosed method 80 for controlling the pumping system 41 of the tool 32 during fluid sampling. The pumping system 41 is controlled preferably by a downhole controller 36 (see FIG. 3) that executes instructions stored in a permanent memory (EPROM) of the tool assembly 30. The downhole controller may insure that the pumping 41 system is not driven beyond its operational limits and may ensure that the pumping system is operating efficiently. The downhole controller collects in situ measurements from the sensor(s) in the tool 31 and/or a sensor(s) in the tool 32 (see FIG. 4) and uses these measurements in adaptive feedback loops of the method 80 to optimize the performance of the pump 41/pumping system.

The method 80 is capable of operating the pumping system 41 of the tool 32 with no or minimal operator interference. Typically, the surface operator may initiate the sampling operation when the tool string 14 has stopped rotating (during a stand pipe connection for example), by sending a command to one or more of the downhole tools 31-33 by telemetry. The tool 32 will operate the pumping system 41 according to the method 80. Any one or more of the tools 31-33 may periodically send information to the surface operator about the status of the sampling process, thereby assisting the surface operator in making decisions such as aborting the sampling, instructing the tool 33 to store a sample in a chamber, etc. The decision of the surface operator may be communicated to the downhole tools 31-33 by mud pulse telemetry. The tools 31, 32 may share downhole clock information.

Beginning at the left in FIG. 5, in part 85, the tool 31 obtains formation/fluid characteristics/parameters that can be computed from the pressure data collected during a pretest as set forth above (see also U.S. Pat. Nos. 5,644,076 and 7,031,841 or U.S. Publication No. 2005/0187715) and sends the parameters to the tool 32 in part 86. Alternatively or in addition, other information from other tools may be sent to the tool 32 in part 86, such as depth of invasion from a resistivity tool, etc.

The following are examples that may be collected or assimilated in part 85 and sent to the tool in part 86: a hydrostatic pressure in the wellbore, a circulating pressure in the wellbore, a mobility of the fluid, which may be characterized as the ratio of the formation permeability to the fluid viscosity, and formation pressure. The pressure differential between the hydrostatic pressure and the formation pressure is also called the overbalance pressure. A pretest, or any other pressure test, may give more information, such as mudcake permeability, that can also be sent to tool 32. Also, fewer or other parameters may be sent to tool 32, for example if the parameters listed above are not available.

In part 87, two operations are performed—87*a* and 87*b*. In 87*a* a desired pump parameter is determined based on information obtained about the formation parameter(s) determined in part 85. In one embodiment, the desired pump parameter may be a "sampling protocol/sequence," which refers to a control sequence for the sampling pump. The sequence may be formulated as prescribed pressure levels, pressure variations, and/or flow rates of the pump and/or the flowlines. These formulations may be expressed as a function of time, volume, etc.

In one embodiment, this sequence contains: (1) an investigation phase where the formation/wellbore model is confirmed, refined or completed, where the pump rate is fine tuned and where the mud filtrate is usually pumped out of the formation; and (2) a storage phase, usually stationary or "low shock", where the fluid is pumped into a sample chamber.

In another example, the sampling protocol/sequence is derived from the mobility in part 85. If the mobility is low, the sampling protocol corresponds to increasing the pump flow rate ("Q") monotonically at a low rate, e.g., Q=0.1 cc/s after 1 min, Q=0.2 cc/s after 2 min, etc. If the mobility is high, the sampling protocol corresponds to increasing the pump flow rate monotonically at a high rate, e.g., Q=1 cc/s after 1 min, Q=2 cc/s after 2 min, etc. The reader will note that these values are for illustrative purposes only, and the actual values will depend typically upon probe inlet diameter among other system variables. The increase in flow rate may continue until system drive limits (power, mechanical load, electrical load) are approached in part 89. The tool 32 may then continue to pump at that level arrived at in part 89 until sufficient mud filtrate is pumped out of the formation and a sample is taken.

In another example, the sampling protocol/sequence is derived by achieving an optimum balance between minimum pump drawdown pressure and maximum fluid volume pumped in a given time. The formation/wellbore model uses a cost function to determine an ideal/optimum/desired pump flow rate Q and its corresponding drawdown pressure differential for the storage phase. The cost function may penalize large drawdown pressure and low pump flow rate. The values or the shape of cost function may be adjusted from data collected during prior sampling operations by the tool 32, and/or from data generated by modeling of sampling operations. Ideally, the ideal/optimum/desired pump flow rate Q and its corresponding drawdown pressure differential lie inside the system capabilities. Optionally, the formation/wellbore model includes a prediction of the contamination level of the sampled fluid by mud filtrate and the cost function includes a contamination level target. The ramping to this ideal/optimum/desired pump flow rate Q may further be determined by minimizing the time taken to investigate formation fluid prior to sample storage. The sampling protocol/sequence may further include variations around the ideal/optimum/desired pump flow rate Q used to confirm or further improve the value of the ideal/optimum/desired pump flow rate Q.

In yet another example, an Artificial Intelligence engine is used to learn proper protocol/sequences, preferably the system capabilities. Artificial Intelligence is used to combine previous sampling operation by the tool and real time measurements to determine a sampling protocol/sequence. The Artificial Intelligence engine uses a down-hole database storing previous run scenarios.

In 87*b*, an expected formation response is calculated based on the formation parameters of part 85 and the corresponding pump parameters of part 87*a*. For example, a formation/wellbore model may be generated that provides a prediction of the formation response to sampling by the tool 32. In one example, the formation/wellbore model is an expression that expresses the drawdown pressure differential, the difference between the hydrostatic pressure in the wellbore and the pressure in the flow line, as a function of the formation flow rate. In particular, this expression is parameterized by the overbalance and the mobility. In another example, the formation/wellbore model comprises a parameter that describes the depth of invasion by the mud filtrate, and the model is capable of predicting the evolution of a fluid property, such as the gas oil ratio, or a contamination level for various sampling scenarios. In yet another example, models known in the art and derived to analyze a pretest (sandface pressure measurement) are adapted to analyze sampling operations (see U.S. Publication No. 2004/0045706) and to predict of the formation response to sampling by the tool 32 under various sampling scenarios. In yet another example, empirical models based on curve fitting techniques or neural network and techniques can also be used.

Note that the formation flow rate and pump flow rate are not always the same. These flow rate usually are predictable from each other with a tool or flow line model, as is well known in the art. In some cases, the formation flow rate is close to the pump flow rate. For simplicity it will be assumed that these two quantity are equals in the rest of the disclosure, but it should be understood that it may be necessary to use a tool of flow line model to compute one from the other one.

Referring now to the right side of FIG. 5. In part 81-84, system parameters are determined. Specifically, in part 81 turbine parameters are determined, which may include determining the maximum power available downhole.

As mentioned previously, the pump 41 is powered by mud flowing downward through a work pipe, in this case through a turbine. The maximum power available for the pump 41 depends on the mudflow rate. The mudflow rate is dependent upon borehole parameters such as depth, diameter, hole deviation, upon the type of mud that is used and upon the local drilling rig. Thus, the mudflow rate is not known in advance and may change for various reasons.

Figure 5A:
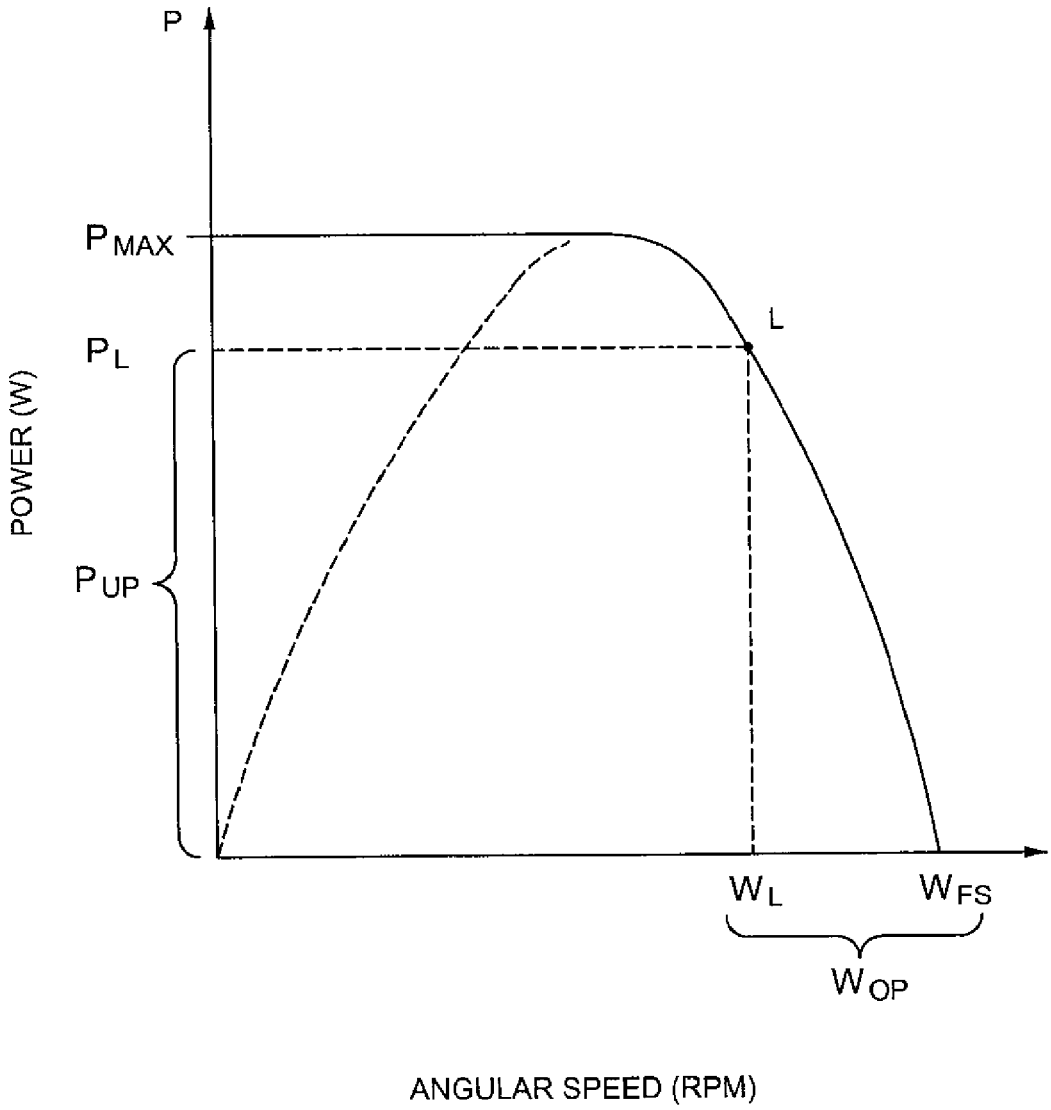
FIG. 5A is a graph depicting a turbine power curve including a maximum power output.

The maximum available power determined in part 81 may be predicted using a model for the turbine 37 and/or turbo-alternator 37, 38. This model may comprise power curves. For example, each power curve expresses the power generated by the turbo-alternator as a function of the turbine angular velocity. FIG. 5A shows one example of a power curve for a given mudflow rate.

As shown in the example of FIG. 5A, the maximum power available $P_{max}$ may be determined from a free spin angular velocity $\omega_{FS}$ and the associated power zero. These values will generate a power curve corresponding to the mud flow rate. This generated power curve has a peak power value $P_{max}$ for limiting pumping operation. Assuming the mud flow rate stays constant, the power curve may be used to correlate a angular velocity $\omega_{OP}$ to any operational power $P_{OP}$.

The maximum of this curve determines the maximum power available downhole in part 81. Note that variations using values of the turbine angular velocity and the generated power over a time period may also be used. These methods may involve regressions techniques, for examples to determine the power curve corresponding to the current mudflow rate from data points collected over a period, and/or to track variations of the mudflow rate over a time period.

The calculated maximum power available downhole computed in part 81 may be used as a pump operation limit. The operation of the pump 41 may be limited based on this and/or other operation limits, as described below with respect to part 89. In one example, the measured operational power by the turbo-alternator 37, 38 $P_{OP}$ is compared to the maximum power $P_{max}$. When the measured generated power approaches the maximum power, the pump flow rate and/or the differential pressure across the pump may be prevented to increase further. Limiting the pumping power, and consequently the power drawn from the turbo-alternator 37, 38, may prevent the turbine from stalling. Preferably, the operating point ("L") may be limited when the measured generated power by the turbo-alternator 37, 38 is around 80% of maximum power available downhole.

In part 82, the control of the pump 41 is further based upon electrical load limitations. Specifically, the motor driver peak current is limited. The peak current is related to the torque required from the motor 35. The motor 35 may thus be controlled by a feedback loop based upon the torque requirement. The driving value of the torque may be limited in part 89 as not to exceed the driver peak current.

In part 83, the pump 41 is further controlled based upon mechanical load limitations. For example, the torque applied on the roller screw 39 may be limited. The motor 35 may be controlled by a feedback loop based upon the torque. The driving value of the torque may be limited as not to exceed the torque load on the roller screw 39 in part 89.

In another example, other mechanical parts, such as the FDU pistons 42, 43 may have limitations in position, tension, or in linear speed. The motor 35 may be controlled by a feedback loop on the torque, rotation speed or number of revolution in order to satisfy these limitations.

In part 84, the control of the pump is further based upon losses in the pumping system or the system loss(es). The maximum available power at the pump output is estimated, tracked or predicted as a function of the maximum available power downhole and losses in the pumping system in part 84. For example, the high power electronics and the electrical driver losses vary with the motor angular velocity, the motor torque, and the temperature. Other losses such as friction losses may also take place in the system. The losses may be predicted by a loss model, that can be continuously adapted as part of the method 80. The motor 35 may be controlled such that the product of motor torque and actual pump rate (the pump output power), does not exceed the maximum available power at the pump output.

Turning to part 89, the pump parameters are updated. Briefly returning to FIG. 4, at the start of the pumping operation, the set pump drive parameters are preferably updated according to the initial pumping operation, which takes place at the finish of the formation pressure test by the probe 201. At the start of the pumping operation, the flowline 204 in the tool 32 is at equilibrium with the formation pressure. The flow line tool three, which is leading to the sampling tool 33 is still closed off by the valve 205 and filled with fluid under hydrostatic pressure. In order not to introduce any pressure shocks to the formation, the pump 41 is operated prior to opening the flowline 203 and the valve block 53 to reduce the lower flowline pressure in the line 75 until it is equal to the formation pressure. Once this has occurred, the lower flowline valve block 53 is opened, and communication to the sampling probe 31 is established to commence pumping. At the beginning of sampling operations, the fluid routing and equalization valve 61 is actuated (i.e., the upper box 61*a* is active) and the pump 41 is activated until the pressure read by sensor 57 is equal to formation pressure, as read by the sensor 210 in the tool 31. Then the sampling isolation valve 205 is opened.

Returning to part 89 of FIG. 5, the operation of the pump is then updated according to the desired pump parameters in part 87*a*, under the control of the prevailing operational conditions determined in one or more of parts 81, 82, 83, and 84. If the desired pump parameters meet the operational conditions, the desired pump parameters are used to update the pump operation; if not, operational condition limits are used to update the pump operation. If the operational limits are reached, the tool 32 may communicate this information to the surface operator. A tool status flag may be sent by telemetry in part 94. The operator upon review of this information can change mudflow rate to increase the turbine 37 speed and generate more power downhole. Also, an increased mudflow rate may lower the temperature of the mud reaching the tool 32 thereby cooling of parts in the tool 32.

In part 90, the formation/wellbore response to sampling by the tool 32 is measured. Specifically, the flow line pressure is measured along with the pump flow rate. Then, the formation flow rate is computed with a tool model. As mentioned before, the formation flow rate may be approximated by pump flowrate.

In addition to the measured formation/wellbore response to sampling by the tool 32, the fluid analysis module 54 may be used to provide feedback to the algorithm. The fluid analysis module 54 may provide optical densities at different wavelength that can be used for example to compute the gas oil ratio of the sampled fluid, to monitor the contamination of the drawn fluid by the mud filtrate, etc. Other uses include the detection bubbles or sand in the flow line which may be indicated by scattering of optical densities.

Part 92*a* relates to comparing the formation/wellbore response measured in part 90 to the expected formation response of part 87*b*. This comparison may be used to fine tune the sampling protocol/sequence 92*b*. In one example, the drawdown differential pressure and the formation flow rate may be compared to a linear model. A pressure drop with respect to a linear trend or a rise less than proportional may indicate a lost seal, gas in the flow line, etc. These events may be confirmed by monitoring a flowline property (such as optical property) in the fluid analysis module.

Furthermore, part 92*a* may include comparing the evolution of a fluid property as measured in part 90 to an expected trend, for example part of model of part 87*b*. For example, a fluid property related to the contamination (such as gas oil ratio) can be monitored and any deviation from an expected trend (known in the art as a clean-up trend) may be interpreted as a lost seal. A lost seal may require an adjustment of the sampling protocol/sequence (92*b*), for example reducing the pump flow rate in order to reduce the pressure differential across the probe packer. Other events may require an adjustment of the sampling protocol/sequence.

In another example, a fluid property is monitored in part 90 to detect if the sample fluid that enters the tool comes in single phase, that is that the sampling pressure is not below the bubble point or the dew precipitation of the reservoir fluid. The fluid property should be sensitive to the presence of bubbles or of solids in a fluid. Fluid optical densities, fluid optical fluorescence, and fluid density or viscosity are properties that can be used for early gas or solid detection when the drawdown pressure drops inadvertently too low in part 90.

In yet another example, the evolution of a fluid property may also be used to calibrate a contamination model. The updated model can be used to predict the time required to achieve a target contamination level, by using methods derived from the art. In another example, a fluid property is monitored and its stationarity is detected and used to inform the surface operator that the pumped fluid is likely uncontaminated and that a sample may be stored.

In part 91, the critical temperatures of pump system are measured, which may include the alternator 38 temperature, the high power electronics temperature and the electrical motor temperature, among others. In part 93, the temperature measured in part 91 is compared to limit values, for example predetermined limit values. Assume for illustration purposes that the alternator temperature was measured in part 91. If this temperature is too high, the motor speed limit may be reduced in part 93*b* in order to reduce the amount of power drawn from the alternator 38 and the heat generated in the alternator 38. In another example, the motor driver temperature may have been measured in part 91. If this temperature is too high, the motor speed limit may be reduced in order to reduce the torque required from the motor 35 and thus the heat generated by the current used to drive the motor 35.

In part 94, data that may be sent to the surface operator include formation pressure and calculated pump rate actual value. The transmission to the surface is usually achieved by mud telemetry. Other values that may be transmitted to the surface include fluid flow data cumulative sampling volume, one or more fluid properties from the fluid analyzer 54, and tool status. The data sent by telemetry are encoded/compressed to optimize communication bandwidth between tools 31/32 and surface during a sampling operation. Operational data may also stored downhole on non-volatile memory (flash memory) for later retrieval upon return to the surface and use.

Figure 6:
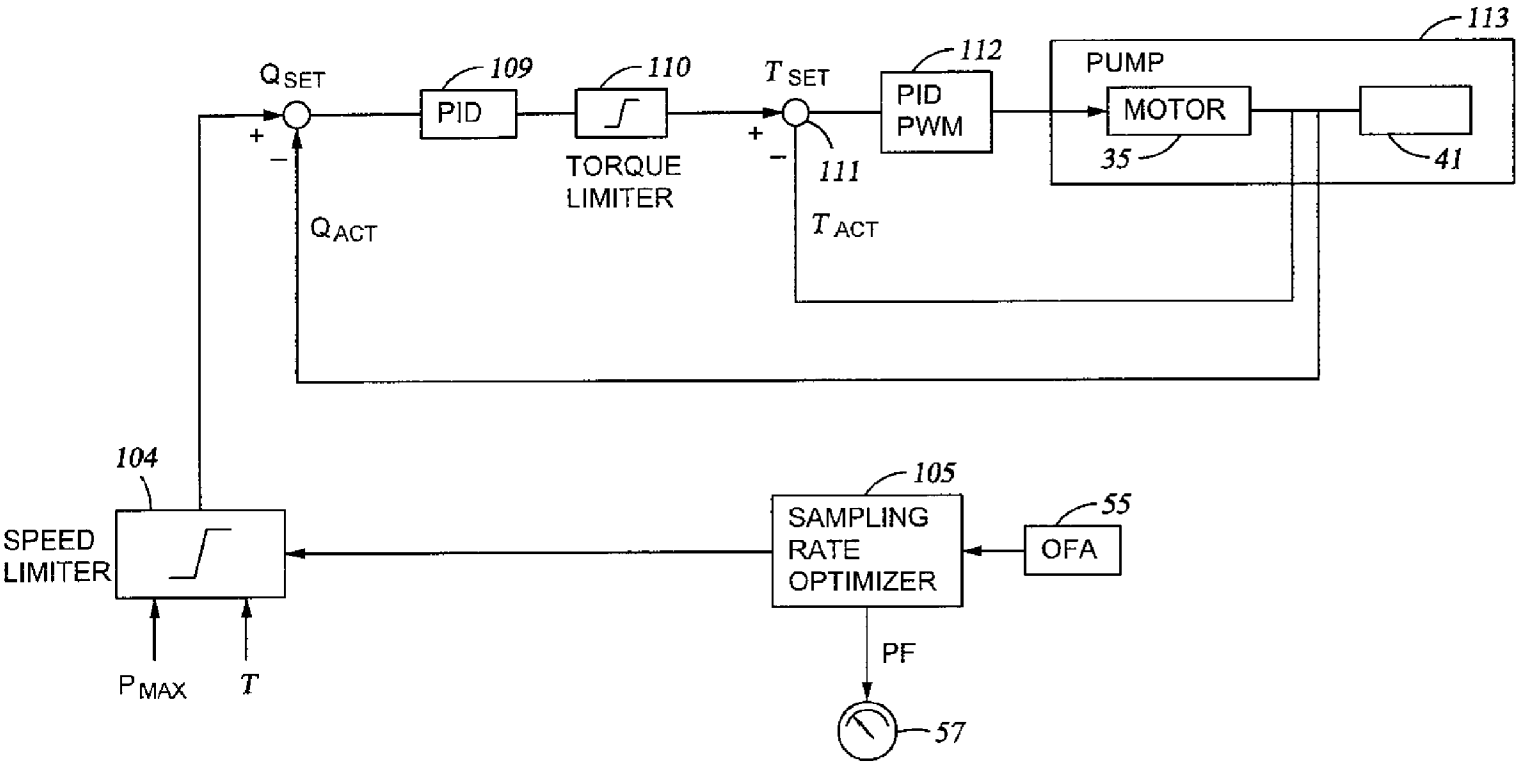
FIG. 6 is an electrical diagram illustrating one sampling control loop used to carry out the method of FIG. 5 to control the pump motor of the disclosed formation testing system.

FIG. 6 illustrates one example of implementation of the method in FIG. 5. The control loop consists of a two layer cascaded control loop system. The control structure is typical for a constant speed motor regulation. The advantage of the proposed tool architecture is that the pump rate is directly coupled with the motor and therefore can be measured and controlled with very high resolution. The resolution is dependent on the motor position measurement implementation. A resolver coupled to the motor delivers high resolution motor position information. The actual pump flow rate $Q_{act}$ can be computed from the motor position information and a system transmission constant. The motor torque actual value $\tau_{act}$ can be computed from the motor phase current and the motor position information.

The inner layer regulates the torque at measured positions; the outer layer regulates the motor speed and thus the pump rate. The actuators in the control loops operate with very fast dynamic response. The dynamic behavior of the formation is much slower than the pump control.

The sampling rate optimizer 105 sets an ideal sampling rate protocol/sequence, and reacts to any change in the behavior of the formation, such as flow line pressure drops detected by the sensor 57, or to any change in the properties of the drawn fluid, such as gas in the flow line detected by optical fluid analyzer 55. The sampling rate analyzer 105 may also continuously adapt the formation model. The sampling rate optimizer 105 feeds the speed limiter 104 with an ideal/optimum/desired flow rate.

The speed limiter 104 tracks temperatures of the system, and predicts the maximum available power from mud circulation. The speed number 104 limits the ideal/optimum/desired flow rate so that the power used by the pumping system does not exceed the maximum available power (within a safety factor of 0.8 for example) and so that the system does not overheats. The PID (proportional integral derivative) regulator 109 adjusts the value of the set torque $\tau_{set}$ from the difference between the pump rate set value $Q_{set}$ and the calculated pump rate actual value $Q_{act}$. The torque limiter 110 insures that the torque required to match the set sampling rate does not exceed the roller screw peak torque and the torque corresponding to the motor driver peak current. The PID (proportional integral derivative) regulator 112 compares the motor torque set value $Q_{set}$ with the calculated pump rate actual value $Q_{act}$.

Figure 7:
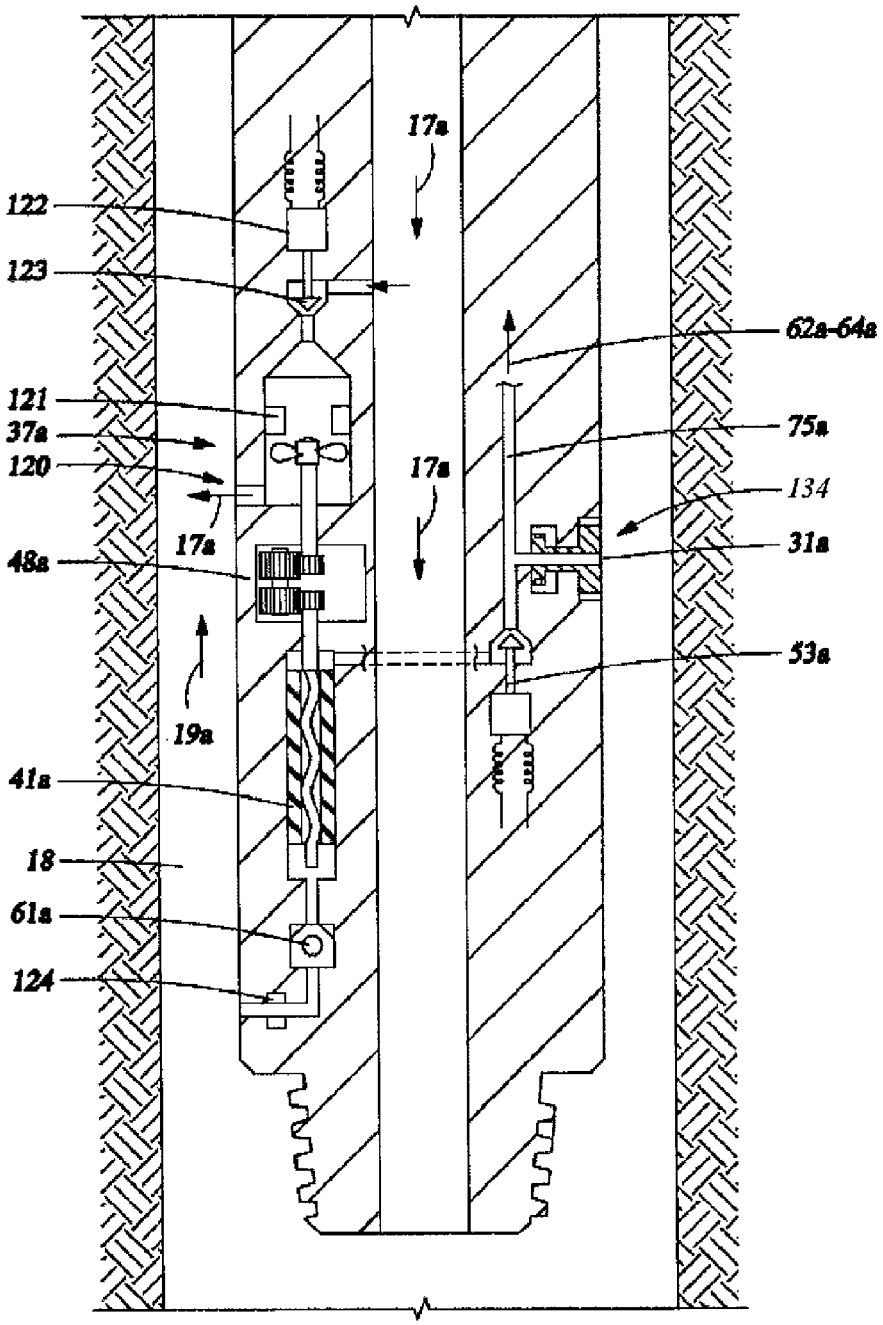
FIG. 7 is a diagram illustrating an alternative pumping unit assembly for use with the disclosed formation testing system.
Figure 8:
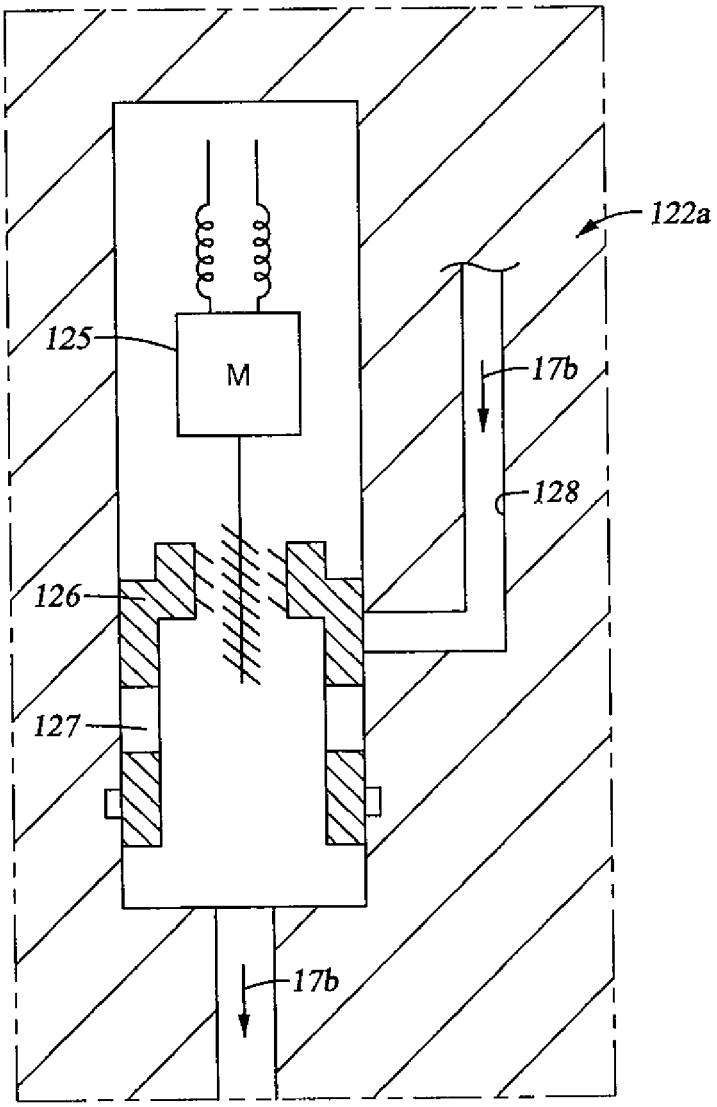
FIG. 8 is a diagram illustrating an alternative throttle valve for the pump unit assembly illustrated in FIG. 7.

The symbols used in FIGS. 5 and 6 are listed below for convenience:

$Q_{set}$: Pump rate set value
$Q_{act}$: Calculated pump rate actual value
$p_f$: Measured flow line pressure
$\tau_{set}$: Motor torque set value
$\tau_{act}$: Motor torque actual value
$P_{max}$: Tracked maximum available turbine power
PWM: Pulse width modulator
PID: Proportional Integral Derivative regulator Finally, FIGS. 7 and 8 illustrate an alternative motor FDU arrangement 41*a*. The motor 41*a* is a Moineau motor which is coupled to a gearbox or other mechanical transmission 48*a*. The gearbox 48*a* is driven by a turbine 37*a* which, in turn, is driven by drilling mud flowing in the direction of the arrows 17*a*. A mud outlet port is shown at 120 and a turbine stator coil is shown at 121. Thus, the pump 41*a* does not include an alternator. Fluid flow to the turbine 37*a* is controlled by way of a solenoid valve 122, which includes a throttle or cone-shaped seat 123. The throttle 123 is adjusted to control the flow of mud going to the turbine 37*a*, therefore controlling the flow of formation fluid pumped by the pumping unit 41*a*. The valve 122 can be controlled at a fixed rate is preferably automatically controlled by the tool embedded software, using flow rate measured by flow meter 124 or pressure of the drawn fluid.

A mud check-valve is shown at 61*a* and a flowmeter at the outlet to the borehole is shown at 124. Sample fluid is communicated from the pump 41*a* through a valve 53*a*, which in this case is another solenoid valve similar to that shown at 122. The flowline 75*a* leads to the sample chambers indicated schematically by the arrow 62*a*-64*a*. The probe inlet is shown at 31*a* with a rubber packer 134. A sensor (not shown) could also be included that monitors properties such as optical densities, fluorescence, resistance, pressure and temperature of the fluid drawn into the tool.

As an alternative, the gearbox 48*a* may be a continuously variable transmission ("CVT"), for example one made with rollers in the transmission ratio controlled by tool embedded software. The gearbox 48*a* may also allow reversing the direction of flow using a continuously variable transmission and an episode click here in combination. The tool of FIG. 7 may also be used for injection procedures.

Turning to FIG. 8, an alternative to the solenoid valve 122 of FIG. 7 is illustrated at 122*a*. A motor 125 is used to drive a sleeve 126 with ports 127 therein into or out of alignment with the mud flow line 128. A flow path of the mud is shown generally by the arrows 17*b*.

While only certain embodiments have been set forth, alternatives and modifications will be apparent from the above description to those skilled in the art. These and other alternatives are considered equivalents and within the spirit and scope of this disclosure and the appended claims.

What is claimed:

1. A method for controlling a pumping system of a formation fluid sampling tool during formation fluid sampling, comprising:

collecting in situ measurements from at least one sensor in the tool; and using the measurements in adaptive feedback loops to control performance of the pumping system.

2. The method of claim 1 wherein the method is capable of operating the pumping system of the tool with no operator interference.

3. The method of claim 1 wherein the adaptive feedback loops at least partially comprise a multi-layer cascaded control loop system.

4. The method of claim 3 wherein the multi-layer cascaded control loop system comprises a first layer and a second layer, wherein the inner layer regulates a torque applied by a motor of the pumping system, and wherein the outer layer regulates a speed of the motor and thus a pump rate of the pumping system.

5. The method of claim 1 further comprising tracking temperatures of the pumping system to predict maximum available power from mud circulation, and using the tracked temperatures and predicted maximum available power to limit a flow rate so that power used by the pumping system does not exceed the maximum available power.

6. A method for controlling a pumping system of a formation fluid sampling tool during formation fluid sampling, comprising:

(a) obtaining formation or formation fluid pressure test data;

(b) determining another formation or formation fluid parameters using the pressure test data;

(c) determining a desired pump parameter based on the other parameter;

(d) determining an expected formation response to sampling the formation, wherein the expected formation response is determined based on the other formation parameter and the desired pump parameter;

(e) predicting maximum power available from a turbine or turbo-alternator of the pumping system;

(f) controlling operation of the pumping system based on the predicted maximum power available, electrical load limitations of the pumping system determined from torque limitations of the pumping system, mechanical load limitations of the pumping system, and losses in the pumping system;

(g) updating parameters of the pumping system as controlling operation of the pumping system proceeds;

(h) updating operation of the pumping system based on the updated parameters according to the desired pump parameters, under the control of prevailing operational conditions determined in one or more previous steps;

(i) measuring the formation response to sampling by the tool; and (j) comparing the measured formation response to the expected formation response.

7. The method of claim 6 wherein the other formation or formation fluid parameter is selected from the group consisting of:

a hydrostatic pressure in the wellbore;

a circulating pressure in the wellbore;

a mobility of the fluid;

formation pressure; and mudcake permeability.

8. The method of claim 6 wherein the desired pump parameter is a control sequence for the pumping system.

9. The method of claim 8 wherein the control sequence is formulated as prescribed pressure levels, pressure variations, and/or flow rates of the pumping system.

10. The method of claim 9 wherein the control sequence is formulated as a function of time or volume.

11. The method of claim 10 wherein the control sequence comprises:

an investigation phase in which a formation model is confirmed, refined or completed, a pump rate is fine tuned, and mud filtrate is pumped out of the formation; and a storage phase in which formation fluid is pumped into a sample chamber of the tool.

12. The method of claim 10 wherein the control sequence is derived from the mobility of the fluid such that:

if the mobility is below a predetermined value, the control sequence corresponds to increasing a flow rate of the pumping system monotonically at a first rate; and if the mobility is above the predetermined value, the control sequence corresponds to increasing the flow rate of the pumping system monotonically at a second rate that is greater than the first rate.

13. The method of claim 12 wherein the control sequence includes increasing the flow rate of the pumping system until predetermined system drive limits are approached, at which time the control sequence includes maintaining the current flow rate of the pumping system until a predetermined amount of mud filtrate is pumped out of the formation and a sample is taken.

14. The method of claim 10 wherein the control sequence is derived by achieving an optimum balance between minimum pump drawdown pressure and maximum fluid volume pumped in a given time using a cost function to determine a desired pumping system flow rate and its corresponding drawdown pressure differential for a storage phase, wherein the cost function penalizes large drawdown pressure and low pumping system flow rate.

15. The method of claim 14 further comprising adjusting the cost function using data collected during prior sampling operations performed with the tool.

16. The method of claim 14 wherein determining the expected formation response includes generating a formation model.

17. The method of claim 16 wherein the formation model relates a drawdown pressure differential as a function of formation flow rate, and wherein the formation model is parameterized by overbalance and mobility of the formation fluid.

18. The method of claim 16 wherein the formation model comprises a parameter describing depth of invasion by mud filtrate, and wherein the formation model predicts evolution of gas-oil ratio or contamination level for a plurality of sampling scenarios.

19. The method of claim 6 wherein predicting the maximum power available from the turbine or turbo-alternator of the pumping system includes using a model for the turbine or turbo-alternator.

20. The method of claim 19 wherein the model for the turbine or turbo-alternator comprises power curves each expressing generated power as a function of angular velocity.

21. The method of claim 6 wherein steps (g) and (h) comprise:

if the desired pump parameters meet the operational conditions, the desired pump parameters are used to update the pump operation;

if not, operational condition limits are used to update the pump operation.

22. The method of claim 6 wherein step (i) comprises measuring a flow line pressure and a pump flow rate, and then computing formation flow rate with a tool model.

23. The method of claim 22 further comprising using a fluid analysis module to provide feedback in the form of optical densities at different wavelengths to compute a gas-oil ratio of the sampled fluid, to monitor contamination of the sampled fluid, or to detect bubbles or sand in the flow line.

24. The method of claim 6 further comprising monitoring a fluid property to detect if the sample fluid that enters the tool comes in single phase, such that the sampling pressure is not below the bubble point or the dew precipitation of the formation fluid.

25. A method for controlling a pumping system of a formation fluid sampling tool during formation fluid sampling, comprising:

(a) obtaining formation or formation fluid pressure test data;

(b) determining another formation or formation fluid parameters using the pressure test data;

(c) determining a desired pump parameter based on the other parameter, wherein the desired pump parameter is a control sequence for the pumping system, wherein the control sequence is formulated as prescribed pressure levels, pressure variations, and/or flow rates of the pumping system, wherein the control sequence is formulated as a function of time or volume, and wherein the control sequence comprises an investigation phase and a storage phase;

(d) determining an expected formation response to sampling the formation, including generating a formation model, wherein the expected formation response is determined based on the other formation parameter and the desired pump parameter, wherein the formation model relates a drawdown pressure differential as a function of formation flow rate, wherein the formation model is parameterized by overbalance and mobility of the formation fluid, wherein the formation model comprises a parameter describing depth of invasion by mud filtrate, and wherein the formation model predicts evolution of gas-oil ratio or contamination level for a plurality of sampling scenarios;

(e) predicting maximum power available from a turbine or turbo-alternator of the pumping system, including using a model for the turbine or turbo-alternator, wherein the model for the turbine or turbo-alternator comprises power curves each expressing generated power as a function of angular velocity;

(f) controlling operation of the pumping system based on the predicted maximum power available, electrical load limitations of the pumping system determined from torque limitations of the pumping system, mechanical load limitations of the pumping system, and losses in the pumping system;

(g) updating parameters of the pumping system as controlling operation of the pumping system proceeds;

(h) updating operation of the pumping system based on the updated parameters according to the desired pump parameters, under the control of prevailing operational conditions determined in one or more previous steps;

(i) measuring the formation response to sampling by the tool, including measuring a flow line pressure and a pump flow rate and then computing formation flow rate with a tool model;

(j) comparing the measured formation response to the expected formation response;

(k) using a fluid analysis module to provide feedback in the form of optical densities at different wavelengths to compute a gas-oil ratio of the sampled fluid, to monitor contamination of the sampled fluid, or to detect bubbles or sand in the flow line; and (l) monitoring a fluid property to detect if the sample fluid that enters the tool comes in single phase, such that the sampling pressure is not below the bubble point or the dew precipitation of the formation fluid;

wherein steps (g) and (h) comprise:

if the desired pump parameters meet the operational conditions, the desired pump parameters are used to update the pump operation;

if not, operational condition limits are used to update the pump operation.

* * * * *